United States Patent [19]

Matsushita

[11] Patent Number: 4,897,333

[45] Date of Patent: Jan. 30, 1990

[54] COPYING METHOD

[75] Inventor: Kouji Matsushita, Osaka, Japan

[73] Assignee: Minolta Camera Kabushiki Kaisha, Osaka, Japan

[21] Appl. No.: 215,513

[22] Filed: Jul. 6, 1988

[30] Foreign Application Priority Data

Jul. 8, 1987 [JP] Japan ..... 62-170481

[51] Int. Cl.[4] ..... G03G 13/22

[52] U.S. Cl. ..... 430/126; 430/31; 430/125

[58] Field of Search ..... 430/31, 126, 126

[56] References Cited

U.S. PATENT DOCUMENTS

| | | | |
|---|---|---|---|
| 4,119,373 | 10/1978 | Frishman | 430/126 X |
| 4,197,121 | 4/1980 | Eckenbach | 430/126 |
| 4,350,750 | 9/1982 | Suzuki et al. | 430/126 X |
| 4,522,904 | 6/1985 | Kina et al. | 430/54 |
| 4,538,901 | 9/1985 | Soumiya | 430/31 X |
| 4,641,158 | 2/1987 | Takeuchi | 346/160 |
| 4,699,864 | 10/1987 | Noma et al. | 430/31 X |

*Primary Examiner*—Roland E. Martin

*Attorney, Agent, or Firm*—Burns, Doane, Swecker & Mathis

[57] ABSTRACT

In an electrophotographic apparatus accommodating a photosensitive member with an amorphous silicon photosensitive layer, a plurality of or a large number of documents can be clearly copied by repeating the following steps:

(a) charging the photosensitive member up to a predetermined electric potential;

(b) exposing the photosensitive member so that an electrostatic latent image may be formed on it;

(c) developing the electrostatic latent image by toner;

(d) applying light to the photosensitive member, the wavelength of which light is primarily less than 600 nm, with the wavelength greater than 600 nm being limited below 30% in energy distribution ratio;

(e) transferring the toner image onto a transfer sheet by imparting electric charge to the entire surface of the transfer sheet from its rear side, with the electric charge being in opposite polarity to the toner image;

(f) removing the toner remaining on the photosensitive member after the transfer; and (g) applying another light to the photosensitive member, the wavelength of which light is primarily between 500 and 700 nm, with the wavelength greater than 600 nm being limited between 30 and 60% in energy distribution ratio.

4 Claims, 1 Drawing Sheet

COPYING METHOD

BACKGROUND OF THE INVENTION

1. Field of the Invention

The present invention generally relates to a copying method, and more particularly, to a method of copying a large number of documents in an electrophotographic apparatus having therein a photosensitive member with an amorphous silicon photosensitive layer.

2. Description of the Prior Art

An electrophotographic apparatus generally accommodates the main eraser to be used as a static eraser. The main eraser applies light to the surface of a photosensitive member after transfer and cleaning to erase the remaining electric charge so that the subsequent electrification may be uniformly executed.

In addition to the main eraser, a pre-transfer eraser is occasionally installed at a location after development and before transfer. The pre-transfer eraser applies light to the surface of the photosensitive member to lower the electric potential of a visible image to which toner adheres, thus resulting in weakened toner adsorptivity and enhanced transfer properties of the visible image.

The installation of the pre-transfer eraser is further advantageous in that a transfer sheet can be readily separated from the photosensitive member, since a setting value of transfer current can be lowered.

The amount of light emitted from the aforementioned erasers, the wavelength thereof and the like have a close connection with the properties of the photosensitive member, and therefore, they are required to be determined in accordance with the kind of the photosensitive member to be used or other factors.

The photosensitive member primarily composed of amorphous silicon recently attracts attention as the photosensitive member superior in resistance to abrasion, light sensitivity, resistance to heat, non-environmental pollution and the like.

However, such a photosensitive member is disadvantageous in that carrier tends to be trapped in a portion to which light is applied during image exposure. Because of this, the surface potential of the portion to which the light has previously been applied undesirably lowers at the time of subsequent electrification, thus causing an image memory, that is to say, a latent image left in the photosensitive member after development. This problem becomes particularly conspicuous when a light source for exposure use emits light having a relatively long wavelength. Even when, for example, a halogen lamp having therein a filter for eliminating long-wavelength component is employed as the light source, the long-wavelength component slightly passing through the filter, in cooperation with other factors, cause the image memory particularly when such a lamp is repeatedly used.

Accordingly, the light source of the main eraser is conventionally so selected as to emit light having plenty of the long-wavelength component which can readily enter the inside of a photosensitive layer. Because, it is well known that the long-wavelength component can release the trapped potential for elimination of the image memory.

However, the amount of light to be emitted from the main eraser is required to be increased for complete elimination of the image memory. This fact causes fatigue of the photosensitive layer which makes it difficult to raise the surface potential of the photosensitive layer, thus resulting in inferior image quality.

On the other hand, it is known that the amount of light to be emitted from the main eraser can be reduced by the pre-transfer eraser employing therein a light source containing the long-wavelength component. It is also known that a charger for erasing use can be used in place of the pre-transfer eraser so that any image memory may not be produced.

However, when the light containing the long-wavelength component is emitted from the pre-transfer eraser, the amount of light to be applied to the visible image portion having thereon the toner greatly differs from that to be applied to the other portion. This fact produces a great difference in the degree of light fatigue of the photosensitive layer, thus occasionally causing the image memory.

If the charger for erasing use is provided, it requires an additional space therefor. Furthermore, since the charger is provided immediately downstream of a developing device, it tends to be soiled by the toner or the like and to cause abnormal discharge.

SUMMARY OF THE INVENTION

Accordingly, the present invention has been developed with a view to substantially eliminating the above described disadvantages inherent in the prior art copying method, and has for its essential object to provide an improved copying method which never cause, during repeated copying operations, an image memory following light fatigue and the decrease of surface potential of a photosensitive member with an amorphous silicon photosensitive layer.

Another important object of the present invention is to provide a copying method of the above described type whereby not only a visible image formed on the photosensitive member can be readily transferred onto a transfer sheet, but the transfer sheet can be readily separated from the photosensitive member.

In accomplishing these and other objects, the present invention provides a novel method of copying a plurality of documents in an electrophotographic apparatus having therein the photosensitive member with an amorphous silicon photosensitive layer. According to the present invention, a plurality of documents can be clearly copied by repeating the following steps:

(a) charging the photosensitive member up to a predetermined electric potential;

(b) exposing the photosensitive member so that an electrostatic latent image may be formed thereon;

(c) toner developing the electrostatic latent image by (d) applying light to the photosensitive member, the wavelength of which light is primarily less than 600 nm, with the wavelength greater than 600 nm being limited below 30% in energy distribution ratio;

(e) transferring the toner image onto a transfer sheet by imparting electric charge to the entire surface of the transfer sheet from its rear side, with the electric charge being in opposite polarity to the toner image;

(f) removing the toner remaining on the photosensitive member after the transfer; and (g) applying another light to the photosensitive member, the wavelength of which light is primarily between 500 and 700 nm, with the wavelength greater than 600 nm being limited between 30 and 60% in energy distribution ratio. By the copying method as described above, electrons entering a photosensitive layer of the photosensitive member can be effectively released therefrom in such a degree that the photosensitive layer is not subjected to the light fatigue which exerts undesirable influence upon the Moreover, the copying method of the present invention never produces any large difference in light fatigue between the portion having thereon the toner and the other portion. In addition, the transfer properties of the visible image can be raised by satisfactorily lowering the potential of a portion of the photosensitive layer having thereon the toner without producing any image memory.

BRIEF DESCRIPTION OF THE DRAWINGS

These and other objects and features of the present invention will become more apparent from the following description taken in conjunction with the preferred embodiment thereof with reference to the accompanying drawings, throughout which like parts are designated by like reference numerals, and wherein.

DETAILED DESCRIPTION OF THE PREFERRED EMBODIMENTS

Figure 1:
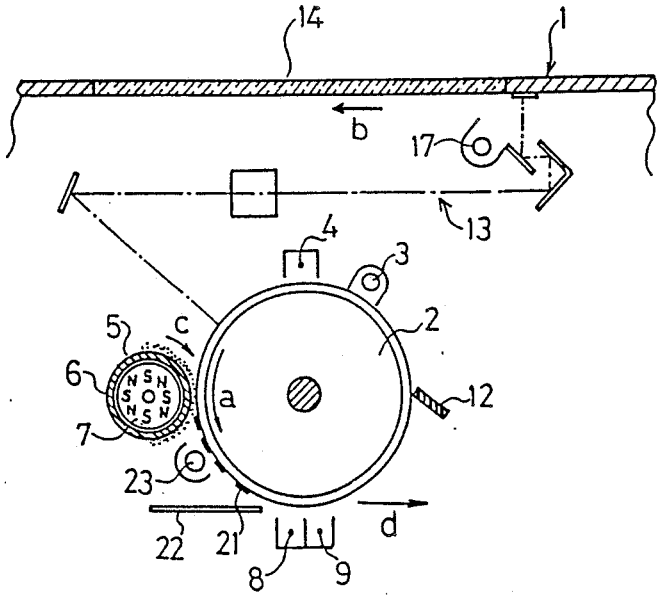
FIG. 1 is a sectional schematic illustration of an electrophotographic copying apparatus employing therein a copying method according to one preferred embodiment of the present invention.

FIG. 1 depicts an electrophotographic copying apparatus employing therein a copying method according to one preferred embodiment of the present invention. The copying apparatus is provided substantially at a central portion within its body 1 with a photoreceptor drum 2 as a photosensitive member, a photosensitive layer of which contains amorphous silicon. The copying apparatus accommodates, along the periphery of the photoreceptor drum 2, the main eraser 3, the main charger 4, a developing device 5, a pre-transfer eraser 23, a DC transfer charger 8, an AC separation charger 9 and a cleaning device 12 in a direction of rotation of the photoreceptor drum 2 shown by an arrow (a).

The upper surface of the copying apparatus is primarily comprised of a glass-made document platform 14 on which an original document to be copied is placed. An image exposure device 13 of a movable optical system is disposed between the photoreceptor drum 2 and the document platform 14. Light from an exposure light source 17, for example a halogen lamp, is applied to an original document placed on the document platform 14 and scans an image formed on the document in a direction of an arrow (b) so that an electrostatic latent image of the document may be formed on the surface of the photoreceptor drum 2 positively charged by the main charger 4.

The developing device 5 is provided with a developing sleeve 6 accommodating a magnetic roller 7 and employs therein the magnetic brush developing method. Magnetic developer is transported on the developing sleeve 6 upon rotation of either the magnetic roller 7 or the developing sleeve 6 in a direction of an arrow (c) and develops the electrostatic latent image formed on the photoreceptor drum 2. The developer consists of insulating toner and magnetic carrier, with the insulating toner being consumed during development.

The electrostatic latent image on the photoreceptor drum 2 turns, through the development, to a visible image 21 having thereon the toner. The visible image 21 is transferred onto a transfer sheet 22 transported in synchronism therewith by virtue of the DC transfer charger 8. After the transfer, the transfer sheet 22 is separated from the photoreceptor drum 2 by the AC separation charger 9 and is transported in a direction of an arrow (d) so that the transferred visible image 21 may be fixed by a fixing device (not shown).

Figure 2:
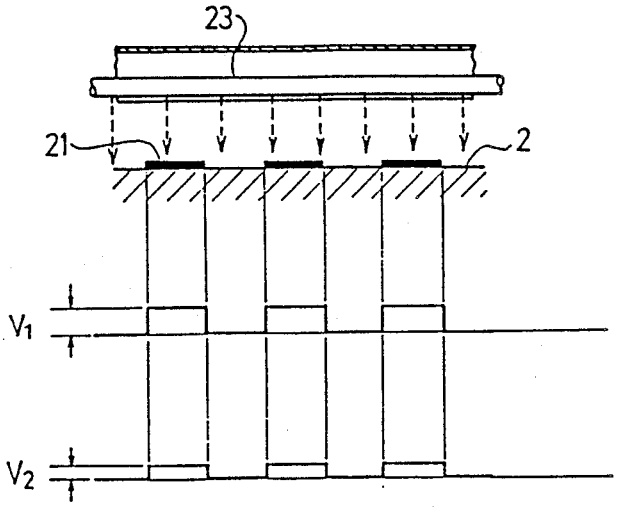
FIG. 2 is a diagram explanatory of the erasing effect of a pre-transfer eraser employed in the copying apparatus of FIG. 1.

The pre-transfer eraser 23 is disposed at a location suitable for applying light to the surface of the photoreceptor drum 2 from above the visible image 21 after the development and before the transfer, as shown in FIGS. 1 and 2. The light applied reaches a visible image support portion through the visible image 21 and erases electric potential of this portion or greatly lowers it from V1 to V2 by virtue of its erasing effect, the potential V1 being close to the potential applied to the visible image support portion when it has been charged. In this way, weakened adsorptivity of the toner facilitates the separation of the visible image 21 from the photoreceptor drum 2 during the subsequent transfer, thereby facilitating reliable transfer.

In the case where the photosensitive layer contains amorphous silicon as in this embodiment, light having a wavelength less than 600 nm is absorbed into a surface layer within 1 μm from the surface and produces "electron hole pairs". As a result, electrons of the electron-hole pairs immediately erase the positive potential on the surface. Light having a wavelength of 700 nm enters the inside of the photosensitive layer over 10 μm from the surface and carriers produced inside the photosensitive layer are partly trapped therein and released therefrom again during the charging process to form the potential in volumetric space. This phenomenon causes light fatigue, for example, the decrease of the surface potential, the increase of dark decay or the like.

Accordingly, if the pre-transfer eraser 23 emits light having wavelength component, which may impose fatigue upon the photoreceptor drum 2, to raise the transfer properties of the visible image 21, the improvement of the transfer properties can be expected to some extent by the decrease of the potential but great light fatigue is imposed upon a portion which has thereon no visible image 21 and to which large amount of light is applied. The difference in the degree of fatigue, therefore, causes the difference in the surface potential or that in potential of exposure value and produces the image memory, thus exerting undesirable influence upon a latter half of the image forming process or the subsequent image forming processes.

In view of the above, an experiment has been executed, using a light source (green cold cathode tube or the like) which emits light primarily of short-wavelength component less than 600 nm as the pre-transfer eraser 23. In this experiment, an energy distribution ratio of long wavelength component greater than 600 nm has been regulated in the range of 0 to 50%. According to the experiment, the evaluation with respect to the image memory is shown in Table 1.

TABLE 1

| Ratio of Long-wavelength Component greater than 600 nm (%) | 0 | 10 | 20 | 30 | 40 | 50 |
|---|---|---|---|---|---|---|

TABLE 1-continued

| | | | | | | |
|---|---|---|---|---|---|---|
| Evaluation to Image Memory | fair | fair | fair | good | poor | poor |

According to the result shown in Table 1, if as the pre-transfer eraser 23 is employed the light source which emits light having primarily the short-wavelength component less than 600 nm on condition that the energy distribution ratio of the long-wavelength component greater than 600 nm is below 30%, the image memory can be limited to some extent.

Meanwhile, the main eraser 3 is required to emit light containing the long-wavelength component which can eliminate the influence by the image exposure and the pre-transfer eraser 23. Accordingly, it is necessary to selectively use a suitable light source which can emit light containing the long-wavelength component to some extent and can release the electric charge trapped inside the photosensitive layer.

Because of this, another experiment has been executed, using another light source [white cold cathode tube) which emits light primarily of the wavelength component between 500 and 700 nm as the main eraser 3. In this experiment, the energy distribution ratio of the long-wavelength component greater than 600 nm has been so regulated as to be in the range of 0 to 70%. The evaluation with respect to the image memory and the decrease of the surface potential is shown in Table 2.

TABLE 2

| Ratio of Long-wavelength Component greater than 600 nm (%) | 0 | 10 | 20 | 30 | 40 | 50 | 60 | 70 |
|---|---|---|---|---|---|---|---|---|
| Evaluation to Image Memory | poor | poor | poor | good | fair | fair | fair | fair |
| Decrease in Potential | fair | fair | fair | fair | fair | good | good | poor |

According to the result of this experiment shown in Table 2, the more the long-wavelength component is, the better with respect to the image memory, but the less the long-wavelength component is, the better with respect to the decrease in potential.

Putting these results together, when the long-wavelength component greater than 600 nm is limited between 30% and 60%, the desirable result can be obtained.

When the main eraser 3 and the pre-transfer eraser 23 satisfies the above described conditions, the visible image having superior transfer properties has been obtained without any influence by the image memory when the electrostatic latent image is formed.

The present invention is also applicable to other electrophotographic apparatus employed, for example, in a laser printer which forms and transfers an image through the electrostatic photographic method.

According to the copying method of the present invention, not only the transfer properties of the visible image can be improved but the image memory can be satisfactorily restrained, thus resulting in that the high-quality image can be obtained.

Although the present invention has been fully described by way of examples with reference to the accompanying drawings, it is to be noted here that various changes and modifications will be apparent to those skilled in the art. Therefore, unless such changes and modifications otherwise depart from the spirit add scope of the present invention, they should be construed as being included therein.

What is claimed is:

1. A method of copying a plurality of documents comprising the steps of:

(a) charging a photosensitive member which has an amorphous silicon photosensitive layer up to a predetermined electric potential;

(b) exposing said photosensitive member to form an electrostatic latent image thereon;

(c) developing said electrostatic latent image by toner;

(d) applying light to said photosensitive member, the wavelength of said light being primarily less than 600 nm, with the wavelength greater than 600 nm being limited below 30% in energy distribution ratio;

(e) transferring the toner image onto a transfer sheet by imparting electric charge to the entire surface of said transfer sheet from its rear side, said electric charge being in opposite polarity to the toner image;

(f) removing said toner remaining on said photosensitive member after the transfer; and (g) applying another light to said photosensitive member, the wavelength of said another light being primarily between 500 and 700 nm, with the wavelength greater than 600 nm being limited between 30 and 60% in energy distribution ratio.

2. The method according to claim 1, wherein a light source used in step (d) emits light having the wavelength primarily less than 600 nm, the wavelength greater than 600 nm being limited below 20% in energy distribution ratio, and another light source used in step (g) emits light having the wavelength primarily between 500 and 700 nm, the wavelength greater than 600 nm being limited between 30 and 50% in energy distribution ratio.

3. The method according to claim 1, wherein said toner used in step (c) is electrically charged in opposite polarity to said electrostatic latent image formed on said photosensitive member.

4. The method according to claim 1, wherein said photosensitive member is positively charged.

* * * * *